US009945222B2

(12) United States Patent
Sugiura et al.

(10) Patent No.: US 9,945,222 B2
(45) Date of Patent: Apr. 17, 2018

(54) CLOSED LOOP CONTROL OF DRILLING CURVATURE

(71) Applicant: Schlumberger Technology Corporation, Sugar Land, TX (US)

(72) Inventors: Junichi Sugiura, Bristol (GB); Peter Hornblower, Gloucester (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 431 days.

(21) Appl. No.: 14/565,378

(22) Filed: Dec. 9, 2014

(65) Prior Publication Data

US 2016/0160628 A1 Jun. 9, 2016

(51) Int. Cl.

| | |
|---|---|
| ***G05B 15/02*** | (2006.01) |
| ***E21B 44/00*** | (2006.01) |
| ***E21B 47/022*** | (2012.01) |
| ***E21B 7/06*** | (2006.01) |

(52) U.S. Cl.
CPC ..... *E21B 44/005* (2013.01); *E21B 7/06* (2013.01); *E21B 47/022* (2013.01)

(58) Field of Classification Search
CPC ..... G05B 15/02; E21B 44/005; E21B 47/022
USPC ..... 700/275; 175/24, 26, 45
See application file for complete search history.

(56) References Cited

U.S. PATENT DOCUMENTS

| | | | | |
|---|---|---|---|---|
| 6,877,241 | B2 | 4/2005 | Barr et al. | |
| 7,136,795 | B2 | 11/2006 | Downton | |
| 7,243,719 | B2 | 7/2007 | Baron et al. | |
| 7,243,735 | B2 * | 7/2007 | Koederitz | E21B 49/003 175/40 |
| 7,350,410 | B2 * | 4/2008 | Ekseth | E21B 47/022 73/152.45 |
| 7,556,105 | B2 | 7/2009 | Krueger | |
| 7,584,788 | B2 | 9/2009 | Baron et al. | |
| 7,823,655 | B2 * | 11/2010 | Boone | E21B 7/068 175/26 |
| 8,118,114 | B2 | 2/2012 | Sugiura | |
| 8,393,412 | B2 | 3/2013 | Camwell et al. | |
| 8,676,558 | B2 | 3/2014 | Pirovolou | |
| 2002/0104685 | A1 | 8/2002 | Pinckard et al. | |
| 2003/0024738 | A1 * | 2/2003 | Schuh | E21B 7/04 175/45 |

(Continued)

FOREIGN PATENT DOCUMENTS

| | | |
|---|---|---|
| WO | 2014/160567 | 10/2014 |

OTHER PUBLICATIONS

Sugiura and Jones, "Automated Steering and Real-Time Drilling Process Monitoring Optimizes Rotary Steerable Underreamer Technology", IADC World Drilling, Jun. 2008.

(Continued)

*Primary Examiner* — Chun Cao

(57) ABSTRACT

A downhole closed loop method for controlling a curvature of a subterranean wellbore while drilling includes drilling the subterranean wellbore using a drilling tool. A set point curvature is received at a downhole controller. Sequential attitude measurements made at a single axial location on the drilling tool and a rate of penetration of drilling are processed to compute a curvature of the wellbore being drilled. The drilling direction is adjusted such that the computed curvature is substantially equal to the set point curvature.

15 Claims, 5 Drawing Sheets

(56) References Cited

U.S. PATENT DOCUMENTS

| | | | | |
|---|---|---|---|---|
| 2003/0034178 | A1* | 2/2003 | Cargill | E21B 7/067 175/73 |
| 2004/0118608 | A1 | 6/2004 | Haci et al. | |
| 2009/0058674 | A1 | 3/2009 | Papouras et al. | |
| 2009/0090555 | A1* | 4/2009 | Boone | E21B 44/02 175/45 |
| 2009/0159336 | A1* | 6/2009 | Boone | E21B 47/022 175/45 |
| 2010/0096186 | A1* | 4/2010 | Ekseth | E21B 7/067 175/45 |
| 2013/0126239 | A1 | 5/2013 | Panchal et al. | |
| 2013/0151157 | A1 | 6/2013 | Brooks et al. | |
| 2013/0151158 | A1 | 6/2013 | Brooks et al. | |
| 2013/0341091 | A1 | 12/2013 | Sugiura | |
| 2014/0151121 | A1 | 6/2014 | Boone et al. | |
| 2014/0196950 | A1 | 7/2014 | Bayliss | |

OTHER PUBLICATIONS

International Search Report issued in related PCT application PCT/US2015/064153 dated Mar. 7, 2016, 4 pages.
Written Opinion issued in related PCT application PCT/US2015/064153 dated Mar. 7, 2016, 9 pages.
International Preliminary Report on Patentability issued in International patent application PCT/US2015/064153 dated Jun. 22, 2017. 11 pages.

* cited by examiner

CLOSED LOOP CONTROL OF DRILLING CURVATURE

CROSS REFERENCE TO RELATED APPLICATIONS

None.

FIELD OF THE INVENTION

Disclosed embodiments relate generally to methods for maintaining directional control during downhole directional drilling operations and more particularly to method for closed loop control of a drilling curvature while drilling.

BACKGROUND INFORMATION

The use of automated drilling methods is becoming increasingly common in drilling subterranean wellbores. Such methods may be employed, for example, to control the direction of drilling based on various downhole feedback measurements, such as inclination and azimuth measurements made while drilling or logging while drilling measurements.

One difficulty with automated drilling methods (and directional drilling methods in general) is that all directional drilling tools exhibit tendencies to drill (or turn) in a direction offset from the set point direction. For example, when set to drill a horizontal well straight ahead, certain drilling tools may have a tendency to drop inclination (turn downward) and/or to turn to the left or right. Exacerbating this difficulty, these tendencies can be influenced by numerous factors and may change unexpectedly during a drilling operation. Factors influencing the directional tendency may include, for example, properties of the subterranean formation, the configuration of the bottom hole assembly (BHA), bit wear, bit/stabilizer walk, an unplanned touch point (e.g. due to compression and buckling of the BHA), stabilizer-formation interaction, the steering mechanism utilized by the steering tool, and various drilling parameters.

In current drilling operations, a drilling operator generally corrects the directional tendencies by evaluating wellbore survey data transmitted to the surface. A surface computation of the dogleg severity (DLS) and gravity toolface of the well is generally performed at 30 to 100 foot intervals (e.g., at the static survey stations). While such techniques are serviceable, there is a need for further improvement, particularly for automatically accommodating (or correcting) such tendencies downhole while drilling; thus controlling the dogleg severity and toolface in a closed-loop manner.

SUMMARY

A downhole closed loop method for controlling a curvature of a subterranean wellbore while drilling is disclosed. The method includes drilling the subterranean wellbore using a drilling tool. A set point curvature is received at a downhole controller. Sequential attitude measurements made at a single axial location on the drilling tool and a rate of penetration of drilling are processed to compute a curvature of the wellbore being drilled. The drilling direction is adjusted such that the computed curvature is substantially equal to the set point curvature.

The disclosed embodiments may provide various technical advantages. For example, the disclosed embodiments provide for real-time closed loop control of the dogleg severity and drilling toolface. As such, the disclosed methods may provide for improved well placement and reduced wellbore tortuosity. Moreover, by providing for closed loop control, the disclosed methods tend to improve drilling efficiency and consistency.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
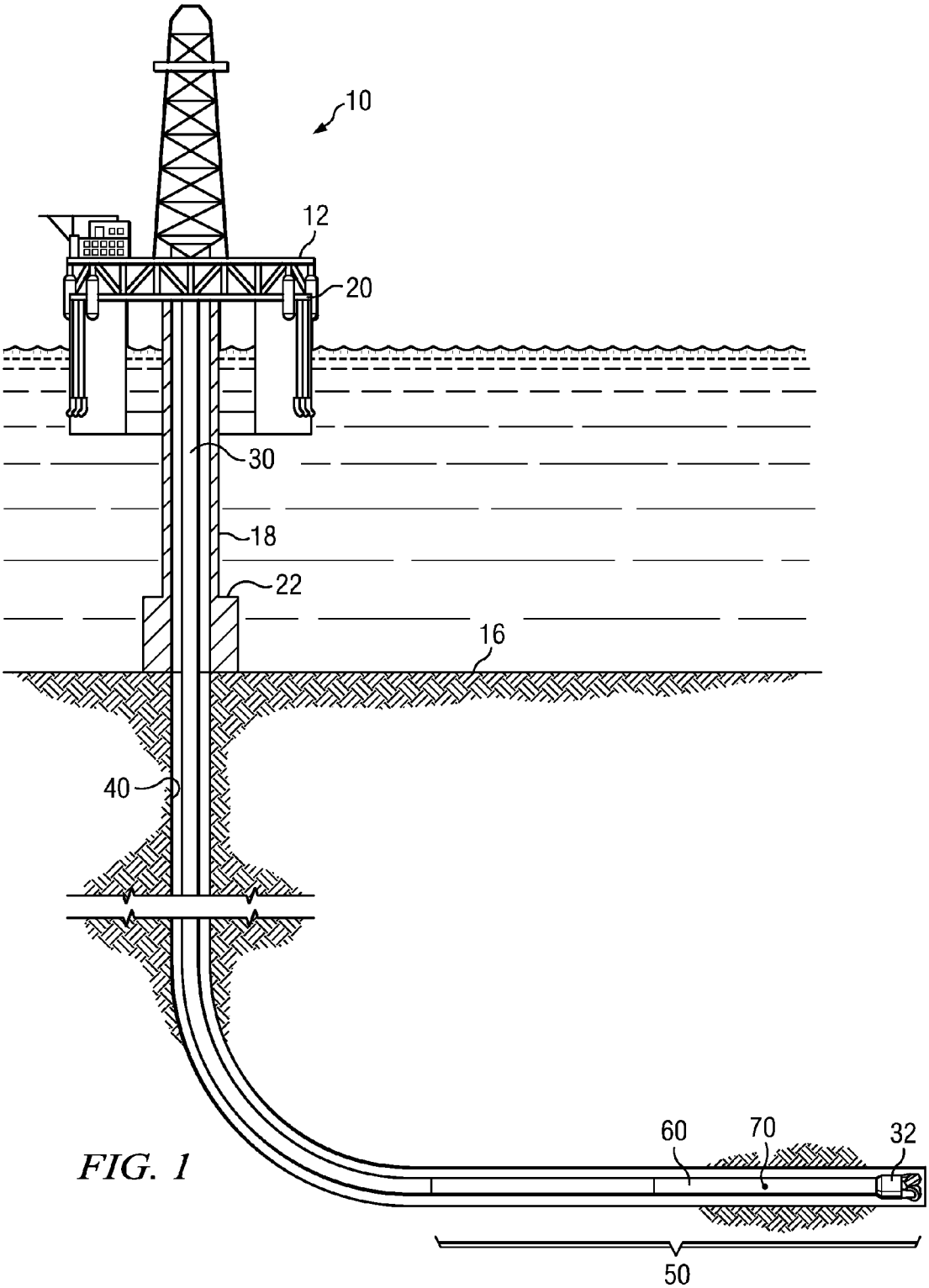
FIG. 1 depicts an example drilling rig on which disclosed embodiments may be utilized.

FIG. 1 depicts a drilling rig 10 suitable for using various method and system embodiments disclosed herein. A semi-submersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus (not shown) for raising and lowering a drill string 30, which, as shown, extends into borehole 40 and includes a bottom hole assembly (BHA) 50. The BHA 50 includes a drill bit 32, a steering tool 60 (also referred to as a directional drilling tool), and one or more downhole navigation sensors 70 such as measurement while drilling sensors including three axis accelerometers and/or three axis magnetometers. The BHA 50 may further include substantially any other suitable downhole tools such as a downhole drilling motor, a downhole telemetry system, a reaming tool, and the like. The disclosed embodiments are not limited in regards to such other tools.

It will be understood that the BHA may include substantially any suitable steering tool 60, for example, including a rotary steerable tool. Various rotary steerable tool configurations are known in the art including various steering mechanisms for controlling the direction of drilling. For example, the PathMaker® rotary steerable system (available from PathFinder® a Schlumberger Company), the Auto-Trak® rotary steerable system (available from Baker Hughes), and the GeoPilot® rotary steerable system (available from Sperry Drilling Services) include a substantially non-rotating outer housing employing blades that engage the borehole wall. Engagement of the blades with the borehole wall is intended to eccenter the tool body, thereby pointing or pushing the drill bit in a desired direction while drilling.

A rotating shaft deployed in the outer housing transfers rotary power and axial weight-on-bit to the drill bit during drilling. Accelerometer and magnetometer sets may be deployed in the outer housing and therefore are non-rotating or rotate slowly with respect to the borehole wall.

The PowerDrive® rotary steerable systems (available from Schlumberger) fully rotate with the drill string (i.e., the outer housing rotates with the drill string). The PowerDrive Xceed® makes use of an internal steering mechanism that does not require contact with the borehole wall and enables the tool body to fully rotate with the drill string. The PowerDrive® X5, X6, and Orbit rotary steerable systems make use of mud actuated blades (or pads) that contact the borehole wall. The extension of the blades (or pads) is rapidly and continually adjusted as the system rotates in the borehole. The PowerDrive Archer® makes use of a lower steering section joined at an articulated swivel with an upper section. The swivel is actively tilted via pistons so as to change the angle of the lower section with respect to the upper section and maintain a desired drilling direction as the bottom hole assembly rotates in the borehole. Accelerometer and magnetometer sets may rotate with the drill string or may alternatively be deployed in an internal roll-stabilized housing such that they remain substantially stationary (in a bias phase) or rotate slowly with respect to the borehole (in a neutral phase). To drill a desired curvature, the bias phase and neutral phase are alternated during drilling at a predetermined ratio (referred to as the steering ratio). Again, the disclosed embodiments are not limited to use with any particular steering tool configuration.

The downhole sensors 70 may include substantially any suitable sensor arrangement used making downhole navigation measurements (borehole inclination, borehole azimuth, and/or tool face measurements). Such sensors may include, for example, accelerometers, magnetometers, gyroscopes, and the like. Such sensor arrangements are well known in the art and are therefore not described in further detail. The disclosed embodiments are not limited to the use of any particular sensor embodiments or configurations. Methods for making real-time while drilling measurements of the borehole inclination and borehole azimuth are disclosed, for example, in commonly assigned U.S. Patent Publications 2013/0151157 and 2013/0151158. In the depicted embodiment, the sensors 70 are shown to be deployed in the steering tool 60. Such a depiction is merely for convenience as the sensors 70 may be deployed elsewhere in the BHA.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

Figure 2:
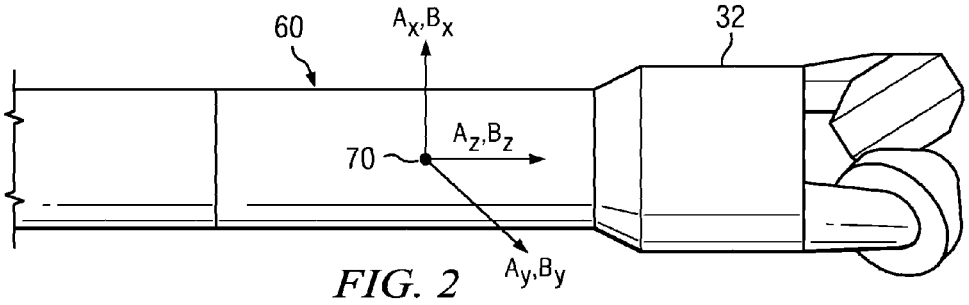
FIG. 2 depicts an example lower BHA portion of the drill string shown on FIG. 1.

FIG. 2 depicts the lower BHA portion of drill string 30 including drill bit 32 and steering tool 60. As described above with respect to FIG. 1, the steering tool may include navigation sensors 70 including tri-axial (three axis) accelerometer and magnetometer navigation sensors. Suitable accelerometers and magnetometers may be chosen from among substantially any suitable commercially available devices known in the art. FIG. 2 further includes a diagrammatic representation of the tri-axial accelerometer and magnetometer sensor sets. By tri-axial it is meant that each sensor set includes three mutually perpendicular sensors, the accelerometers being designated as $A_x$, $A_y$, and $A_z$ and the magnetometers being designated as $B_x$, $B_y$, and $B_z$. By convention, a right handed system is designated in which the z-axis accelerometer and magnetometer ($A_z$ and $B_z$) are oriented substantially parallel with the borehole as indicated (although disclosed embodiments are not limited by such conventions). Each of the accelerometer and magnetometer sets may therefore be considered as determining a plane (the x and y-axes) and a pole (the z-axis along the axis of the BHA).

Figure 3:
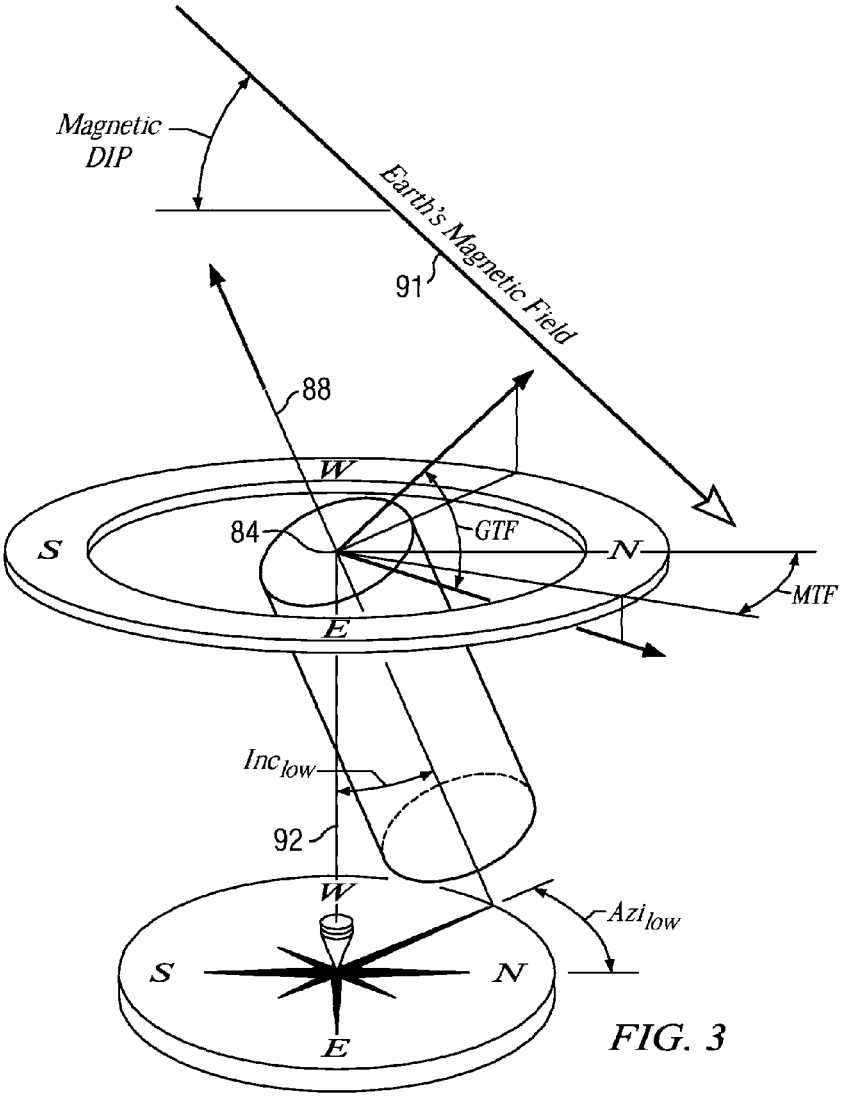
FIG. 3 depicts a diagram of gravity toolface and magnetic toolface in a global reference frame.

FIG. 3 depicts diagram of attitude and toolface in a global coordinate reference frame. The attitude of a BHA defines the orientation of the BHA axis 88 in three-dimensional space. In wellbore surveying applications, the wellbore attitude represents the direction of the BHA axis 88 in the global coordinate reference frame (and is commonly understood to be approximately equal to the direction of propagation of the drill bit). Attitude may be represented by a unit vector the direction of which is often defined by the borehole inclination and the borehole azimuth. The Earth's magnetic field and gravitational field are depicted at 91 and 92. The borehole inclination Inc represents the deviation of axis 88 from vertical (the direction of the Earth's gravitational field) while the borehole azimuth Azi represents the deviation from magnetic north of a projection of the axis 88 on the horizontal plane. Gravity toolface (GTF) is the angular deviation about the circumference of the downhole tool of some tool component with respect to the highside (HS) of the tool collar (or borehole). In this disclosure gravity tool face (GTF) represents the angular deviation between the direction towards which the drill bit is being turned and the highside direction (e.g., in a slide drilling operation, the gravity tool face represents the angular deviation between a bent sub scribe line and the highside direction). Magnetic toolface (MTF) is similar to GTF but uses magnetic north as a reference direction. In particular, MTF is the angular deviation in the horizontal plane between the direction towards which the drill bit is being turned and magnetic north.

It will be understood that the disclosed embodiments are not limited to the above described conventions for defining borehole coordinates depicted in FIGS. 2, 3, and 4. It will be further understood that these conventions can affect the form of certain of the mathematical equations that follow in this disclosure. Those of ordinary skill in the art will be readily able to utilize other conventions and derive equivalent mathematical equations.

Disclosed embodiments provide a closed-loop method for controlling the drilling curvature of a subterranean wellbore. It will be understood by those of ordinary skill in the art that the curvature of a wellbore is commonly defined in one of two ways (although numerous others are possible). First, the curvature may be quantified by specifying the build rate and the turn rate of the borehole. The 'build rate' refers to the change in inclination of the wellbore (and thus refers to a vertical component of the curvature). The 'turn rate' refers to the change in azimuth of the wellbore (and thus refers to a horizontal component of the curvature). The curvature of a wellbore is also commonly quantified by specifying the dogleg severity and the toolface of the wellbore (i.e., the magnitude and direction of the curvature). As used herein 'dogleg severity' refers to the magnitude of the curvature (e.g., in units of degrees per hundred feet of measured depth) and may be thought of as being related to the radius of curvature. The 'toolface' refers to the angular direction to which the wellbore is turning (e.g., relative to the high side when looking down the wellbore). For example, a toolface of 0 degrees indicates a borehole that is turning upwards (i.e., building inclination), while a tool face of 90 degrees indicates a borehole that is turning to the right. A tool face of 45 degrees indicates a borehole that is turning upwards and to the right (i.e., simultaneously building and turning to the right).

Figure 4A:
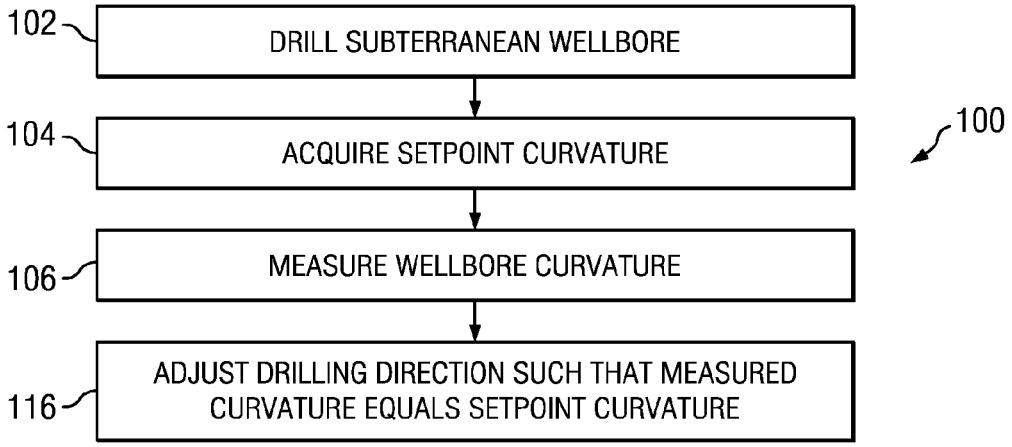
FIGS. 4A and 4B depict flow charts of disclosed closed loop methods.
Figure 4B:
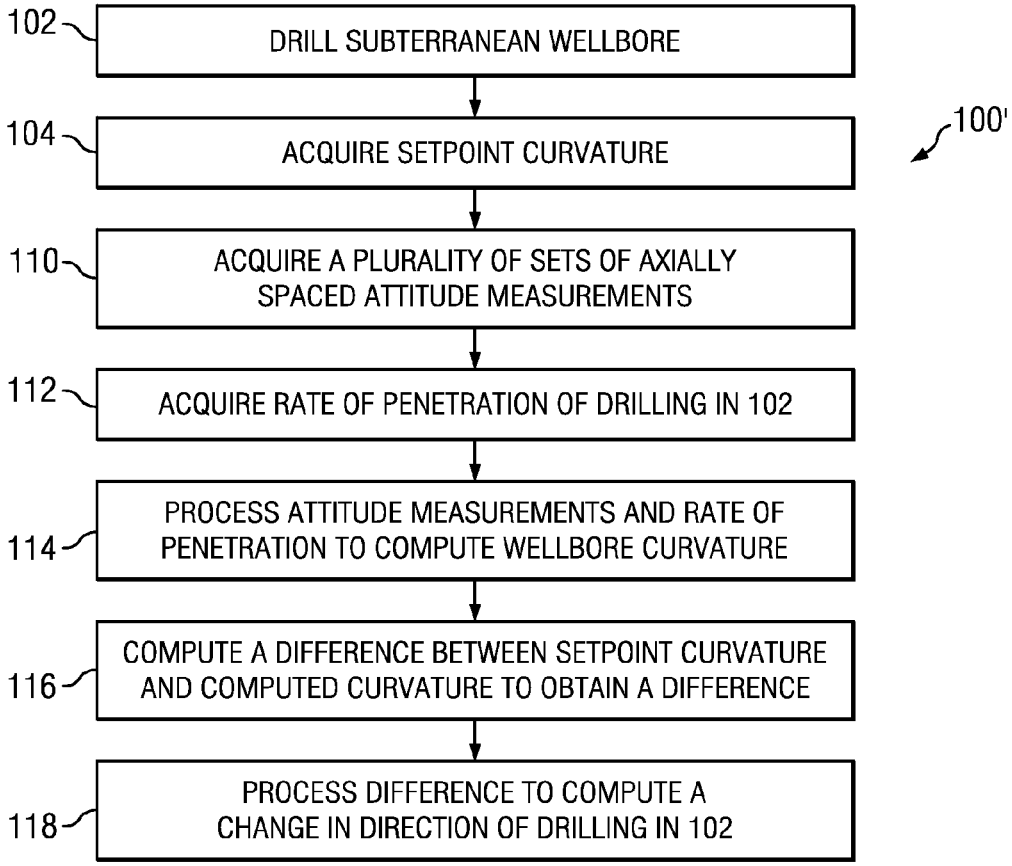

FIGS. 4A and 4B depict flow charts of example method embodiments 100 and 100'. In FIG. 4A a bottom hole assembly including a directional drilling tool (such as a rotary steerable tool) is used to drill a wellbore at 102. A set point curvature is acquired downhole at 104 (e.g., via downlinking a build rate and turn rate or a dogleg severity and toolface). The curvature of the wellbore being drilled is repeatedly measured while drilling at 106 and compared with the set point curvature. For example, sequential attitude measurements made at a single axial location on the drilling tool and a rate of penetration of drilling may be processed to compute a curvature of the wellbore being drilled. The direction of drilling may then be adjusted at 108 as required such that the measured curvature is substantially equal to the set point curvature.

Method 100' (FIG. 4B) is similar to method 100 (FIG. 4A) in that it includes drilling a subterranean wellbore at 102 and acquiring a set point curvature at 104. A plurality of sets of axially spaced (and temporally spaced) attitude measurements (inclination and azimuth measurements) are acquired downhole (e.g., measured at the direction drilling tool) using a single navigation sensor at 110 while drilling at 102. A rate of penetration of drilling at 102 is also acquired downhole at 112. At least two of the attitude measurements (i.e., at least two sets of inclination and azimuth measurements) acquired at 110 and the rate of penetration acquired at 112 are processed at 114 to compute the curvature (e.g., the build rate and turn rate or the dogleg severity and toolface) while drilling in 102. The set point curvature acquired at 104 and the computed curvature are compared at 116 to obtain a difference which is in turn processed at 118 to compute a change in the direction of drilling in 102 as necessary. For example, when the difference is less than a predetermined threshold then the directional drilling tool settings remain unchanged and drilling continues. When the difference is greater than the threshold, the steering tool settings may be adjusted appropriately so as to adjust the drilling direction along the desired course. As also indicated on FIG. 4B steps 110 through 118 may be repeated continuously while drilling so as to continuously control the curvature while drilling. Moreover, subsequent set point curvatures (e.g., dogleg severity and toolface) values may be received at any time during the drilling operation.

Figure 5A:
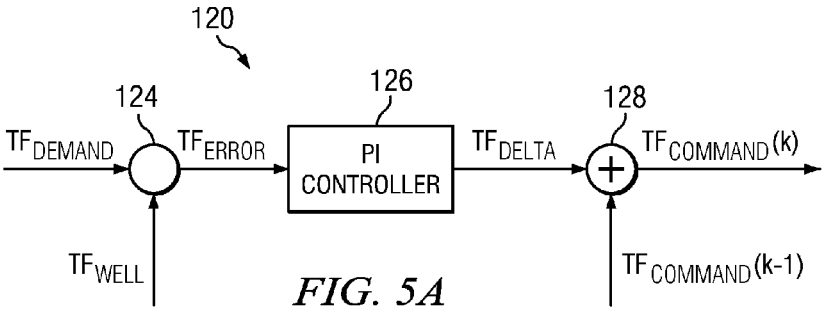
FIGS. 5A and 5B depict disclosed PI controllers suitable for use in the closed loop methods disclosed on FIGS. 4A and 4B.
Figure 5B:
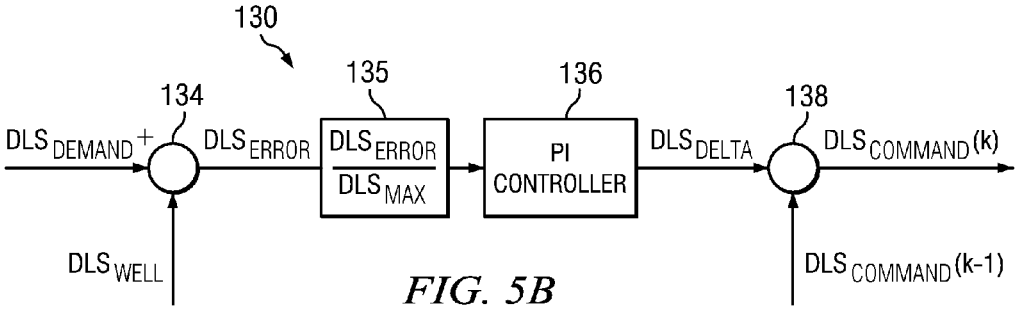

FIGS. 5A and 5B depict schematic diagrams of proportional integral controllers 120 and 130 that may be used to compare the demand dogleg severity and toolface values and the measured values at 116 and process the differences at 118. In FIG. 5A, the demand toolface $TF_{demand}$ is compared with the measured toolface $TF_{well}$ at 124 to obtain a toolface error $TF_{error}$. The measured toolface $TF_{well}$ may be computed, for example, from the measured inclination and azimuth values using one of the following equations:

$$TF_{well} = \operatorname{atan}\left[\frac{\sin(Inc2)\cdot\sin(Azi2-Azi1)}{\cos(Inc1)\cdot\sin(Inc1)\cdot\cos(Azi2-Azi1)-\sin(Inc1)\cdot\cos(Inc2)}\right] \quad (1)$$

$$TF_{well} = \operatorname{atan2}[\sin(Inc2)\cdot(Azi2-Azi1),\ (Inc2-Inc1)] \quad (2)$$

where Inc2 and Azi2 represent the most current inclination and azimuth measurements and Inc1 and Azi1 represent previously measured inclination and azimuth values (e.g., at a location 5 or 10 feet above Inc2 and Azi2). The toolface error $TF_{error}$ is processed using the PI controller 126 to obtain a change in toolface $TF_{delta}$ which is summed with the most recent toolface command value $TF_{command}(k-1)$ at 128 to obtain an updated toolface command value $TF_{command}(k)$.

In FIG. 5B, the demand dogleg severity $DLS_{demand}$ is compared with the measured dogleg severity $DLS_{well}$ at 134 to obtain a dogleg severity error $DLS_{error}$. The measured dogleg severity $DLS_{well}$ may be computed, for example, from the measured inclination and azimuth values using one of the following equations:

$$DLS_{well} = \operatorname{acos}\{\cos(Inc2-Inc1)-\sin(Inc1)\cdot\sin(Inc2)\cdot[1-\cos(Azi2-Azi1)]\} \quad (3)$$

$$DLS_{well} = \sqrt{(Inc2-Inc1)^2+\sin(Inc1)\cdot\sin(Inc2)\cdot(Azi2-Azi1)^2} \quad (4)$$

It will be understood that $DLS_{well}$ represents a change in angular direction in units of degrees. The computed value may be converted to the conventional units of degrees per unit measured depth, for example, degrees per 100 feet of measured depth by multiplying $DLS_{well}$ by $100/(ROP\cdot\Delta t)$ where ROP represents the measured rate of penetration of drilling and $\Delta t$ represents the time interval between measuring Inc1, Azi1 and Inc2, Azi2.

The dogleg severity error $DLS_{error}$ may then be scaled, for example at 135, via dividing by a maximum achievable dogleg severity $DLS_{max}$ (e.g., the maximum dogleg severity that the drilling tool can achieve). This ratio (the scaled dogleg severity error) may be processed using the PI controller 136 to obtain a change in steering ratio $SR_{delta}$ which may be summed at 138 with the most recent steering ratio command value $SR_{command}(k-1)$ to obtain an updated steering ratio command $SR_{command}(k)$. It will be understood that the PI controllers 120 and 130 may be iterated each time new inclination and azimuth values are measured and used to compute $TF_{well}$ and $DLS_{well}$. They may also be iterated when new command toolface and dogleg severity values are received downhole.

While not depicted it will be understood that controllers comparable to those depicted on FIGS. 5A and 5B may alternatively be used to compare build rate and turn rate values. In such embodiments, the build rate and turn rate may be computed from the inclination and azimuth measurements, for example, as follows:

$$BR = \frac{100\cdot(Inc2-Inc1)}{ROP\cdot\Delta t} \quad (5)$$

$$TR = \frac{100\cdot(Azi2-Azi1)}{ROP\cdot\Delta t} \quad (6)$$

where, as defined above, ROP represents the measured rate of penetration of drilling and $\Delta t$ represents the time interval between measuring Inc1, Azi1 and Inc2, Azi2.

The demand tool face and dogleg severity and the measured dogleg severity and toolface may also be compared at 116, for example, using a parametric model that equates the measured curvature with a demand (or set point) curvature of the drilling tool and a deviation. For example, multiple build rate and turn rate measurements may be acquired (e.g., as described above with respect to elements 110, 112, and 114 of FIG. 4B) and input into a parametric model along with a demand dogleg severity and toolface. The model may then be processed to obtain the deviation(s), for example, the drop rate and walk rate of the drilling tool in the particular formation being drilled. The demand dogleg severity and toolface may then be adjusted such that the drilling tool drills the desired curvature (e.g., the desired dogleg severity and toolface).

Substantially any suitable parametric model may be utilized. For example, a suitable four-parameter parametric model may be given as follows:

$$BR=C_{11}[SR\cdot DLS_{max}\cdot\cos(TF)]+DR$$

$$TR=C_{22}[SR\cdot DLS_{max}\cdot\sin(TF)]+WR \quad (7)$$

where BR and TR represent the build and turn rate components of the measured curvature (e.g., as defined above in Equations 5 and 6), SR represents the steering ratio of the drilling tool, $DLS_{max}$ represents the maximum achievable dogleg severity of the drilling tool, TF represents the toolface, DR and WR represent the drop and turn rates of the drilling tool (i.e., the deviations from the setpoint curvature), and $C_{11}$ and $C_{22}$ represent model parameters.

One example of a suitable six-parameter parametric model may be given as follows:

$$\begin{bmatrix} BR \\ TR \end{bmatrix} = \begin{bmatrix} C_{11} & C_{12} \\ C_{21} & C_{22} \end{bmatrix} \begin{bmatrix} SR\cdot DLS_{max}\cdot\cos(TF) \\ SR\cdot DLS_{max}\cdot\sin(TF) \end{bmatrix} + \begin{bmatrix} DR \\ WR \end{bmatrix} \quad (8)$$

where $C_{11}$, $C_{12}$, $C_{21}$, and $C_{22}$ represent model parameters.

Figure 6:
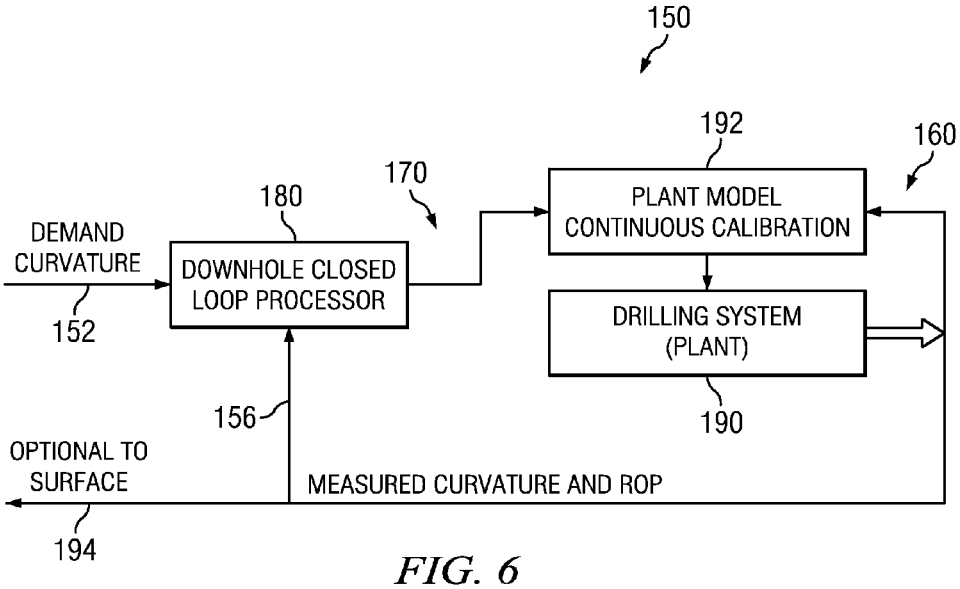
FIG. 6 depicts a block diagram of one embodiment of a closed loop system for controlling curvature while drilling.

FIG. 6 depicts a block diagram of one example embodiment 150 of a disclosed closed loop system for controlling drilling curvature (e.g., the toolface and dogleg severity) during drilling. The disclosed system includes an inner loop depicted generally at 160 and an outer loop depicted generally at 170. A demand curvature (e.g., a dogleg severity and a demand toolface) is intermittently downlinked at 152 from the surface to a downhole closed loop controller 180 in the outer loop 170. The actual curvature (e.g., the dogleg severity and toolface) and rate of penetration may be measured downhole (or computed using other measurements) and are also received 156 at the closed loop controller 180. The downhole closed loop controller 180 processes the received parameters (the downlinked demand dogleg severity and toolface and the measured or computed dogleg severity, toolface, and rate of penetration) using a parameter model (such as one of the four-parameter or six-parameter models described above) to compute at least build and walk biases of the downhole drilling tool. These computed values may then be processed in the inner loop 170 using a plant model 192 (e.g., similar to the parameter models described above) to continuously calibrate the plant 190 (the drilling system in the wellbore) using continuously measured inclination, azimuth, and rate of penetration values. In this way the drilling path may be continuously controlled along a path having a predetermined curvature. It will be understood that in Equations 7 and 8 TF represents the toolface setting on steering tool. In some embodiments $TF=TF_{demand}+TF_{offset}$ where $TF_{offset}$ represents the offset in the toolface setting which may be solved for using the parametric equations.

FIG. 6 further depicts at 194 that the measured curvature and/or rate of penetration may be uplinked (transmitted) to a surface controller. Measured inclination and azimuth values may alternatively and/or additionally be uplinked. The surface controller may be configured to process these uplinked measurements to provide further control. For example, the surface controller may compute a new demand curvature for which may then be downlinked 152 to the downhole processor 180. In this way a surface processor may form a further outer loop that may be used to calibrate the downhole processing (or merely to provide redundancy).

Figure 7:
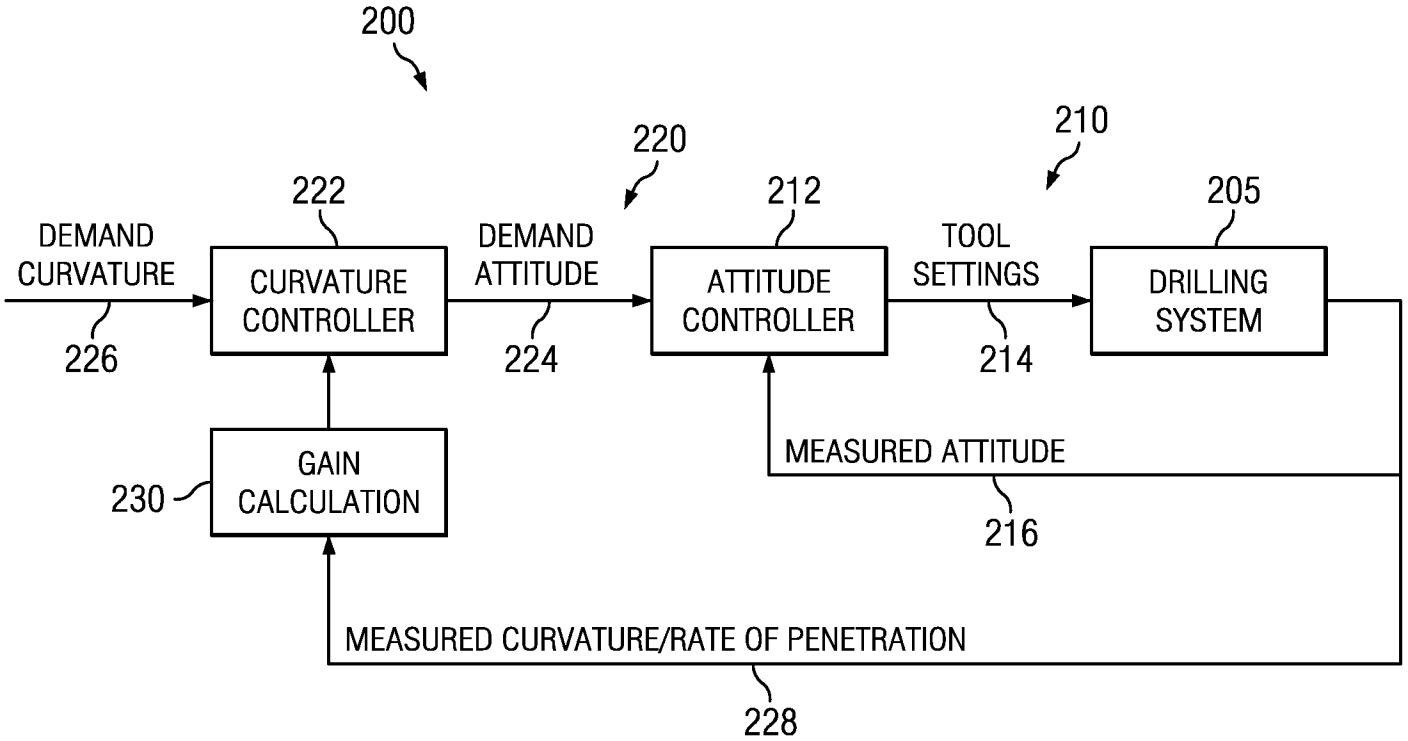
FIG. 7 depicts a block diagram employing cascading loop controllers.

FIG. 7 depicts an alternative embodiment 200 of the inner loop 160 depicted on FIG. 6. The depicted embodiment employs cascading loops including first and second cascading (or nested) inner loops 210 and 220 that control the direction of drilling. The first inner loop 210 includes an attitude controller 212 that controls the drilling attitude (i.e., the inclination and azimuth) of the drilling tool by automatically varying steering tool settings 214 (such as the steering ratio and toolface) in response to a computed error generated by comparing a target attitude (received from controller 222) with a measured attitude 216. These steering tool settings are applied to the drilling system 205. The second inner loop includes a curvature controller 222 that controls the drilling curvature by automatically varying the demand attitude 224 (inclination and azimuth) in response to a computed error generated by processing a demand curvature 226 and a measured rate of penetration and a measured curvature 228.

The attitude controller 212 in the first inner loop 210 may include substantially any suitable controller configured to automatically control the trajectory of drilling. One suitable example is disclosed in U.S. Patent Publication 2013/0126239 which is incorporated by reference herein in its entirety. Sugiura and Jones describe another attitude example of an attitude controller in Sugiura and Jones, "*Automated Steering and Real-Time Drilling Process Monitoring Optimizes Rotary Steerable Underreamer Technology*", *IADC World Drilling*, June 2008. In alternative embodiments, the attitude controller may include other control schemes including, for example, adaptive control, model predictive control, linear-quadratic-Gaussian control, and the like. These controllers may be continuous or discrete as well as linear or non-linear.

The curvature controller 222 may be configured to increment the demand inclination and azimuth 224 at some predetermined time interval (e.g., once per minute). For example, the inclination and azimuth increments may be computed as follows:

$$\Delta Inc=G\cdot DBR\cdot ROP/N \quad (9)$$

$$\Delta Azi=G\cdot DTR\cdot ROP/N \quad (10)$$

where ΔInc and ΔAzi represent the inclination and azimuth increments, DBR and DTR represent the demand build rate and demand turn rate (which together represent the demand curvature), ROP represents the measured rate of penetration (e.g., in units of feet per hour), N represents an interval (e.g., the number of increments per hour such as N=60 for increments every minute), and G represents a gain factor. The gain factor may be computed from the measured curvature, for example, as depicted at 230 on FIG. 7. The gain factor may be computed, for example, as a ratio between the demand curvature and the measured curvature (e.g., between the demand build rate and the measured build rate and between the demand turn rate and the measured turn rate). In such an example, the gain factor may be greater than 1 when the measured curvature is less than the demand curvature and less than 1 when the measured curvature is greater than the demand curvature. The gain may also be computed using any suitable controller (or control scheme), for example, including a proportional integral controller.

As described above with respect to FIGS. 4 and 6, the disclosed methodology may make use of downhole measurements of the rate of penetration of drilling (e.g., at 112 on FIG. 4B and at 156 on FIG. 6). The rate of penetration may be measured using substantially any suitable methodology. For example, when the drilling system (bottom hole assembly) includes first and second axially spaced navigation sensors, continuous sensor readings may be matched to obtain a time shift between the two sets of sensor data. The rate of penetration may then be computed from the known axial separation distance between the two sensors. This methodology is described, for example, in commonly assigned U.S. Patent Publication 2013/0341091, which is fully incorporated by reference herein.

The borehole curvature (the dogleg severity and toolface or the build rate and turn rate) may also be computed from navigation sensor measurements made at first and second axially spaced navigation sensors. Such methods are disclosed for example in U.S. Pat. No. 7,243,719 which is fully incorporated by reference herein. While such measurements may be suitable they require precise calibration of the first and second navigation sensors. It may therefore be advantageous to compute the wellbore curvature using a single navigation sensor as described above.

The rate of penetration may also be measured using continuous measurements from a single navigation sensor (at a single axial location in the bottom hole assembly), for example, using an expected open loop steering response (e.g., an expected open loop dogleg severity). For example, the rate of penetration may be computed as follows: $ROP=\beta/(\Delta t \cdot DLS)$ where $\beta$ represents a wellbore angle change between first and second survey stations, DLS represents the open loop steering response, and $\Delta t$ represents the time interval between measuring Inc1, Azi1 and Inc2, Azi2 as described above. The wellbore angle change may be computed, for example, as described in commonly assigned PCT Patent Application WO 2014/160567, which is fully incorporated by reference herein.

It will be understood that the toolface control and ROP estimation obtained from a single navigation sensor may be calibrated against the two-sensor measurements described above. Such calibration may prove advantageous as the two sensor measurements may in some instances have increased accuracy but at the expense of a slower response time. For example, the two-sensor response may be on the order of 50 feet of measured depth while drilling while the one sensor response is on the order of 5 feet of measured depth. ROP information (drilling speed) may be integrated in the downhole tool to compute the distance between two sensor (inclination and azimuth) measurement points.

During the course of a drilling operation, measured depth errors may accumulate (e.g., due to small errors in the computed rate of penetration and the errors inherent in mathematical integration). The measured depth may be calibrated (i.e., adjusted) on occasion based on measured depth values obtained at the surface. For example, the surface measured depth may be downlinked at some interval (e.g., once per hour, once every 2 drill stands, and the like) and compared with the downhole computed measured depth. Any discrepancy between the surface measured depth and the downhole computed measured depth may then be evaluated and used to correct the downhole computed measured depth. Alternatively, surface measured ROP may be downlinked to the tool on occasion to calibrate downhole computed ROP.

It will be understood that in practice the rate of penetration may be obtained from multiple sources and computed (and acquired) downhole using multiple redundant methods (e.g., the multiple methods set forth above). These multiple measures may be processed in combination to obtain an appropriate value. For example, in one embodiment the multiple rate of penetration measures may be averaged to obtain an average measure. Alternatively and/or additionally one measure obtained at a lower frequency may be used to calibrate another measure obtained at a higher frequency. For example, a two-sensor measure may be used to calibrate a one-sensor measure. And uphole measure may also (or alternatively) be used to calibrate downhole measures of the rate of penetration. The disclosed embodiments are not limited in these regards.

The methods described herein are configured for downhole implementation via one or more controllers deployed downhole (e.g., in a steering/directional drilling tool). A suitable controller may include, for example, a programmable processor, such as a microprocessor or a microcontroller and processor-readable or computer-readable program code embodying logic. A suitable processor may be utilized, for example, to execute the method embodiments described above with respect to FIGS. 4A, 4B, 5A, 5B, 6, and 7 as well as the corresponding disclosed mathematical equations. A suitable controller may also optionally include other controllable components, such as sensors (e.g., a depth sensor), data storage devices, power supplies, timers, and the like. The controller may also be disposed to be in electronic communication with the attitude sensors (e.g., to receive the continuous inclination and azimuth measurements). A suitable controller may also optionally communicate with other instruments in the drill string, such as, for example, telemetry systems that communicate with the surface. Alternatively the controller may be located partially or entirely at the surface and configured to process data sent to the surface via any suitable telemetry or data link. Wired drill pipe is one example of a high-speed downhole telemetry system that enables high-speed two-way communications. A suitable controller may further optionally include volatile or non-volatile memory or a data storage device.

Although closed loop control of drilling curvature and certain advantages thereof have been described in detail, it should be understood that various changes, substitutions and alterations may be made herein without departing from the spirit and scope of the disclosure as defined by the appended claims.

What is claimed is:

1. A downhole closed loop method for controlling a curvature of a subterranean wellbore while drilling, the method comprising:

(a) drilling the subterranean wellbore;

(b) receiving a set point curvature at a downhole controller;

(c) acquiring a plurality of axially spaced attitude measurements using a single navigation sensor;

(d) acquiring a rate of penetration of drilling in (a);

(e) processing at least two of the axially spaced attitude measurements acquired in (c) and the rate of penetration acquired in (d) to compute a wellbore curvature while drilling in (a);

(f) comparing the set point curvature received in (b) and the wellbore curvature computed in (e) to obtain a curvature error; and (g) processing the curvature error to compute a change in the direction of drilling in (a), wherein the wellbore curvature computed in (e) comprises a dogleg severity and a toolface, and wherein the dogleg severity DLS or the toolface TF is computed from the axially spaced attitude measurements acquired in (c) and the rate of penetration acquired in (d) using at least one of the following equations:

$$DLS = \frac{100 \cdot \text{acos}\{\cos(Inc2 - Inc1) - \sin(Inc1) \cdot \sin(Inc2) \cdot [1 - \cos(Azi2 - Azi1)]\}}{ROP \cdot \Delta t}$$

$$DLS = \frac{100 \cdot \sqrt{(Inc2 - Inc1)^2 + \sin(Inc1) \cdot \sin(Inc2) \cdot (Azi2 - Azi1)^2}}{ROP \cdot \Delta t}$$

$$TF = \text{atan}\left[\frac{\sin(Inc2) \cdot \sin(Azi2 - Azi1)}{\cos(Inc1) \cdot \sin(Inc1) \cdot \cos(Azi2 - Azi1) - \sin(Inc1) \cdot \cos(Inc2)}\right]$$

$$TF = \text{atan2}[\sin(Inc2) \cdot (Azi2 - Azi1), (Inc2 - Inc1)]$$

where Inc2 and Inc1 represent axially spaced inclination measurements, Azi2 and Azi1 represent axially spaced azimuth measurements, ROP represents the rate of penetration acquired in (d), and Δt represents a time interval between first and second of the attitude measurements acquired in (c).

2. The method of claim 1, further comprising:

(h) substantially continuously repeating (c), (d), (e), (f), and (g) while drilling in (a).

3. The method of claim 1, wherein the wellbore curvature computed in (e) further comprises a build rate and a turn rate.

4. The method of claim 3, wherein the build rate BR and the turn rate TR are computed from the axially spaced attitude measurements acquired in (c) and the rate of penetration acquired in (d) using the following equations:

$$BR = \frac{100 \cdot (Inc2 - Inc1)}{ROP \cdot \Delta t}$$

$$TR = \frac{100 \cdot (Azi2 - Azi1)}{ROP \cdot \Delta t}$$

wherein Inc2 and Inc1 represent axially spaced inclination measurements, Azi2 and Azi1 represent axially spaced azimuth measurements, ROP represents the rate of penetration acquired in (d), and Δt represents a time interval between first and second of the attitude measurements acquired in (c).

5. The method of claim 1, wherein the comparing in (f) and the processing in (g) in combination comprises:

(i) comparing a set point toolface and a computed wellbore toolface to obtain a toolface error;

(ii) processing the toolface error using a proportional integral controller to obtain a change in toolface setting; and (iii) summing the change in toolface setting with a toolface command value to obtain an updated toolface command value.

6. The method of claim 1, wherein the comparing in (f) and the processing in (g) in combination comprises:

(i) comparing a set point dogleg severity and a computed dogleg severity to obtain a dogleg severity error;

(ii) dividing the dogleg severity error by a maximum achievable dogleg severity of a downhole steering tool to obtain a dogleg severity ratio;

(iii) processing the dogleg severity ratio using a proportional integral controller to obtain a change in steering ratio for the downhole steering tool; and (iv) summing the change in steering ratio with a steering ratio command value to obtain an updated steering ratio command value.

7. The method of claim 1, wherein the comparing in (f) comprises via inputting a plurality of the wellbore curvatures computed in (e) and the set point curvature received in (b) into a parametric model to obtain the curvature error.

8. The method of claim 7, wherein (g) comprises changing a demand curvature of a steering tool such that the wellbore curvature measured in (e) is substantially equal to the set point curvature.

9. The method of claim 7, wherein the parametric model comprises at least one of the following equations:

$$BR = C_{11}[SR \cdot DLS_{max} \cdot \cos(TF)] + DR$$

$$TR = C_{22}[SR \cdot DLS_{max} \cdot \sin(TF)] + WR$$

$$\begin{bmatrix} BR \\ TR \end{bmatrix} = \begin{bmatrix} C_{11} & C_{12} \\ C_{21} & C_{22} \end{bmatrix} \begin{bmatrix} SR \cdot DLS_{max} \cdot \cos(TF) \\ SR \cdot DLS_{max} \cdot \sin(TF) \end{bmatrix} + \begin{bmatrix} DR \\ WR \end{bmatrix}$$

where BR and TR represent build rate and turn rate components of curvature measured in (e), SR represents a steering ratio of a downhole steering tool, $DLS_{max}$ represents a maximum achievable dogleg severity of the steering tool, TF represents a toolface, DR and WR represent a drop rate and turn rate of the steering tool, and $C_{11}$, $C_{12}$, $C_{21}$, and $C_{22}$ represent model parameters.

10. The method of claim 1, wherein (d) further comprises:

(i) acquiring a plurality of rate of penetration measurements; and (ii) processing the plurality of rate of penetration measurements to obtain the rate of penetration of drilling in (a).

11. The method of claim 1, wherein (d) further comprises:

(i) acquiring first and second rate of penetration measurements; and (ii) calibrating the first rate of penetration measurement with the second rate of penetration measurement.

12. A downhole closed loop method for controlling a curvature of a subterranean wellbore while drilling, the method comprising:

(a) causing a drilling tool to drill the subterranean wellbore;

(b) receiving a set point curvature at a downhole controller;

(c) processing (i) sequential attitude measurements made at a single axial location on the drilling tool and (ii) a rate of penetration of drilling to compute a curvature of the wellbore being drilled in (a); and (d) adjusting a direction of drilling such that the computed curvature is substantially equal to the set point curvatures, wherein the wellbore curvature computed in (c) comprises a dogleg severity and a toolface, and wherein the dogleg severity DLS or the toolface TF is computed from the sequential attitude measurements acquired in (c) and the rate of penetration acquired in (c) using at least one of the following equations:

$$DLS = \frac{100 \cdot \text{acos}\{\cos(Inc2 - Inc1) - \sin(Inc1) \cdot \sin(Inc2) \cdot [1 - \cos(Azi2 - Azi1)]\}}{ROP \cdot \Delta t}$$

-continued $$DLS = \frac{100 \cdot \sqrt{(Inc2 - Inc1)^2 + \sin(Inc1) \cdot \sin(Inc2) \cdot (Azi2 - Azi1)^2}}{ROP \cdot \Delta t}$$

$$TF = \operatorname{atan}\left[\frac{\sin(Inc2) \cdot \sin(Azi2 - Azi1)}{\cos(Inc1) \cdot \sin(Inc1) \cdot \cos(Azi2 - Azi1) - \sin(Inc1) \cdot \cos(Inc2)}\right]$$

$$TF = \operatorname{atan2}[\sin(Inc2) \cdot (Azi2 - Azi1), (Inc2 - Inc1)]$$

where Inc2 and Inc1 represent axially spaced inclination measurements, Azi2 and Azi1 represent axially spaced azimuth measurements, ROP represents the rate of penetration acquired in (c), and Δt represents a time interval between first and second of the attitude measurements acquired in (c).

13. The method of claim 12, further comprising:

(e) continuously repeating (c) and (d) while drilling in (a).

14. The method of claim 12, wherein (d) further comprises:

(i) processing the set point curvature received in (b) and the curvature of the wellbore computed in (c) in an outer loop to obtain a demand attitude;

(ii) processing the demand attitude and a measured attitude in an inner loop to obtain steering tool settings; and (iii) applying the steering tool settings to adjust the direction of drilling.

15. A downhole closed loop method for controlling a curvature of a subterranean wellbore while drilling, the method comprising:

(a) drilling the subterranean wellbore;

(b) receiving a set point curvature at a downhole controller;

(c) acquiring a plurality of axially spaced attitude measurements using a single navigation sensor;

(d) acquiring a rate of penetration of drilling in (a);

(e) processing at least two of the axially spaced attitude measurements acquired in (c) and the rate of penetration acquired in (d) to compute a wellbore curvature while drilling in (a);

(f) comparing the set point curvature received in (b) and the wellbore curvature computed in (e) to obtain a curvature error; and (g) processing the curvature error to compute a change in the direction of drilling in (a), wherein the comparing in (f) and the processing in (g) in combination comprises:

(i) comparing a set point dogleg severity and a computed dogleg severity to obtain a dogleg severity error;

(ii) dividing the dogleg severity error by a maximum achievable dogleg severity of a downhole steering tool to obtain a dogleg severity ratio;

(iii) processing the dogleg severity ratio using a proportional integral controller to obtain a change in steering ratio for the downhole steering tool; and (iv) summing the change in steering ratio with a steering ratio command value to obtain an updated steering ratio command value.

* * * * *